US006131663A

United States Patent [19]

Henley et al.

[11] Patent Number: 6,131,663

[45] Date of Patent: Oct. 17, 2000

[54] METHOD AND APPARATUS FOR POSITIONING AND REPOSITIONING A PLURALITY OF SERVICE TOOLS DOWNHOLE WITHOUT ROTATION

[75] Inventors: David A. Henley, Spring; Michael E. McMahan, Humble, both of Tex.

[73] Assignee: Baker Hughes Incorporated, Houston, Tex.

[21] Appl. No.: 09/095,507

[22] Filed: Jun. 10, 1998

[51] Int. Cl.[7] ..... E21B 33/124; E21B 33/128; E21B 33/129; E21B 34/14

[52] U.S. Cl. ..... 166/373; 166/119; 166/191; 166/332.3; 166/386; 166/387

[58] Field of Search ..... 166/119, 123, 166/134, 181, 191, 332.3, 334.2, 381, 383, 373, 386, 387

[56] References Cited

U.S. PATENT DOCUMENTS

| | | | |
|---|---|---|---|
| 2,327,092 | 8/1943 | Botkin | 166/119 |
| 2,343,075 | 2/1944 | Otis | 166/119 |
| 2,903,066 | 9/1959 | Brown | 166/119 X |
| 3,351,133 | 11/1967 | Clark, Jr. et al. | 166/188 X |
| 4,237,979 | 12/1980 | Weise . | |
| 4,279,306 | 7/1981 | Weitz | 166/312 |
| 4,427,063 | 1/1984 | Skinner | 166/134 |
| 4,569,396 | 2/1986 | Brisco | 166/305.1 |
| 4,794,989 | 1/1989 | Mills | 166/387 |
| 4,815,538 | 3/1989 | Burroughs | 166/312 |
| 4,862,961 | 9/1989 | Neff | 166/119 X |
| 4,928,762 | 5/1990 | Mamke | 166/192 |
| 4,962,815 | 10/1990 | Schultz et al. | 166/387 |
| 4,967,844 | 11/1990 | Brooks et al. | 166/123 X |
| 5,143,015 | 9/1992 | Lubitz et al. | 166/187 |
| 5,178,219 | 1/1993 | Striech et al. | 166/289 |
| 5,267,617 | 12/1993 | Perricone et al. | 166/387 |
| 5,456,322 | 10/1995 | Tucker et al. | 166/386 |
| 5,727,632 | 3/1998 | Richards | 166/387 |
| 5,813,456 | 9/1998 | Milner et al. | 166/135 |

FOREIGN PATENT DOCUMENTS

| | | |
|---|---|---|
| 0196796A2 | 6/1986 | European Pat. Off. . |
| 0 496 540 A1 | 1/1992 | European Pat. Off. . |

*Primary Examiner*—George Suchfield
*Attorney, Agent, or Firm*—Duane, Morris & Heckscher LLP

[57] ABSTRACT

A method and apparatus is disclosed for downhole remediation. In the preferred embodiment, a bridge plug and service packer can be run into a well on coiled or rigid tubing. The assembly is capable of being set without rotation. The service packer is locked against setting until it is separated from the bridge plug. Setting of the bridge plug closes a passage within it that had been open to facilitate circulation during run-in. The service packer is set with longitudinal movements using an indexing mechanism. At the conclusion of the procedure, the service packer is released and lowered to recapture the bridge plug. The bridge plug is equalized and released to allow the assembly to be repositioned elsewhere in the wellbore or retrieved. The spacing between the packer and bridge plug can be varied as desired.

18 Claims, 13 Drawing Sheets

METHOD AND APPARATUS FOR POSITIONING AND REPOSITIONING A PLURALITY OF SERVICE TOOLS DOWNHOLE WITHOUT ROTATION

FIELD OF THE INVENTION

The field of this invention relates to methods and equipment to allow running of a plurality of service tools downhole together and to deploy them where desired and redeploy them in the well, all preferably without rotation of at least one of the tools from the surface.

BACKGROUND OF THE INVENTION

As techniques have become more sophisticated for locating subterranean reservoirs, wellbores have become more deviated in an effort to extract the hydrocarbons from below the surface. Coiled tubing has become more prevalent in running tools downhole. Even if rigid tubing is used in a deviated wellbore, actuation of downhole tools using rotation becomes difficult. With the downhole tools supported on coiled tubing, rotation is not possible as part of a technique to set or release downhole tools.

Many reservoir treatment procedures require isolation of a specific zone in the wellbore and the application of fluids to the formation in the isolated zone. In order to accomplish this, the zone is generally isolated between a bridge plug located below and a service packer above. A work string is connected to the service packer for access between the two isolation devices so that, for example, the formation can be acidized between the bridge plug and the service packer above. In many situations, the process must be repeated at multiple locations. One technique that has been used in the past where multiple locations need to be isolated is that the lowermost location has an expendable bridge plug set below it and the service packer is run on a work string to define the first zone to be treated. When the next zone needs to be treated, the service packer is removed from the wellbore and another expendable bridge plug is inserted to define the lower portion of the next zone to be isolated. The service packer is then run in the hole again and the next zone is isolated. This process is repeated until all zones to be treated have been isolated in a similar fashion. At the conclusion of the treatment or procedure, the service packer is removed and all the bridge plugs which have been placed in the wellbore are milled out. There are distinct disadvantages in this procedure in that it requires multiple trips in and out of the well with the service packer so that subsequent bridge plugs can be deployed. Each of the bridge plugs must be separately run in the well and ultimately milled out. Thus, improvements to this technique have generally involved reducing the mill-out time for all the bridge plugs that are in the wellbore. One way this has been accomplished is to make the bridge plugs of generally soft, nonmetallic components so that they can be drilled quickly. Typical of such plugs which are designed to be easily drilled out are U.S. Pat. Nos. 5,224,540 and 5,271,468 issued to Halliburton.

Another way to accomplish the goal of servicing discrete portions of a wellbore in one trip is to use a straddle tool which has a pair of packers which can be set and unset as desired. One of the disadvantages of this type of a tool is that the distance between the packing elements on the tool is defined at the surface when the bottomhole assembly is put together. These tools, typically referred to as "wash tools," are illustrated in U.S. Pat. Nos. 4,815,538; 4,279,306; 4,794,989; 5,267,617; 4,962,815; 4,569,396; and 5,456,322.

Another method of isolating and treating zones is accomplished by running a retrievable bridge plug below a service packer. The coupled system is run just below the zone of interest, the bridge plug is set and uncoupled from the service marker. The service packer is then moved up the hole just above the zone and set by rotation and weight to complete the zone isolation. When treatment is complete, the service packer is unset, moved downhole to recouple with the bridge plug, then unset and moved up the hole to repeat the operation.

Service packers and bridge plug systems that individually set with rotation and setdown force are known. These packer/bridge plug combinations have been used in the procedure described above involving one trip to accomplish straddles of different zones. Typical of such packers are the Retrievamatic® and model G retrievable bridge plug offered by Baker Oil Tools and the RTTS service packer and 3L bridge plug offered by Halliburton. Tension-set packers, involving a rotation and pickup force, are also known. Typical of these are the Baker Oil Tools Model C "Full Bore" service packer and the Model C cup-type bridge plug.

What is desirable and is an object of the present invention is to provide an apparatus and method to allow isolation of zones of various lengths in a wellbore by allowing deployment of isolation devices where desired where the isolation devices are actuated without rotation. Another objective of the present invention is to allow redeployment of the isolation devices in different locations in the wellbore without a trip out of the well. More particularly, where rotation is not possible, the objective is to allow for the deployment and redeployment and separation downhole between the isolation devices, using fluid pressure and/or longitudinal movements only. Yet another objective of the present, when used with a bridge plug and a service packer, is to keep the service packer locked against setting while the bridge plug is being set. Thereafter, when the service packer is separated from the set bridge plug, the act of separation unlocks the service packer, allowing it to be subsequently set on further manipulations when it reaches its desired location in the wellbore. Yet another objective is to allow the boftomhole assembly to be open to circulation during run-in and closed off when the bridge plug is set. The bridge plug can be equalized by reopening a passage therethrough prior to release of the bridge plug. These and other objectives of the present invention will be more apparent to those of skill in the art from a review of the preferred embodiment described below.

SUMMARY OF THE INVENTION

A method and apparatus is disclosed for downhole remediation. In the preferred embodiment, a bridge plug and service packer can be run into a well on coiled or rigid tubing. The assembly is capable of being set without rotation. The service packer is locked against setting until it is separated from the bridge plug. Setting of the bridge plug closes a passage within it that had been open to facilitate circulation during run-in. The service packer is set with longitudinal movements using an indexing mechanism. At the conclusion of the procedure, the service packer is released and lowered to recapture the bridge plug. The bridge plug is equalized and released to allow the assembly to be repositioned elsewhere in the wellbore or retrieved. The spacing between the packer and bridge plug can be varied as desired.

DETAILED DESCRIPTION OF THE PREFERRED EMBODIMENT

Figure 1A:
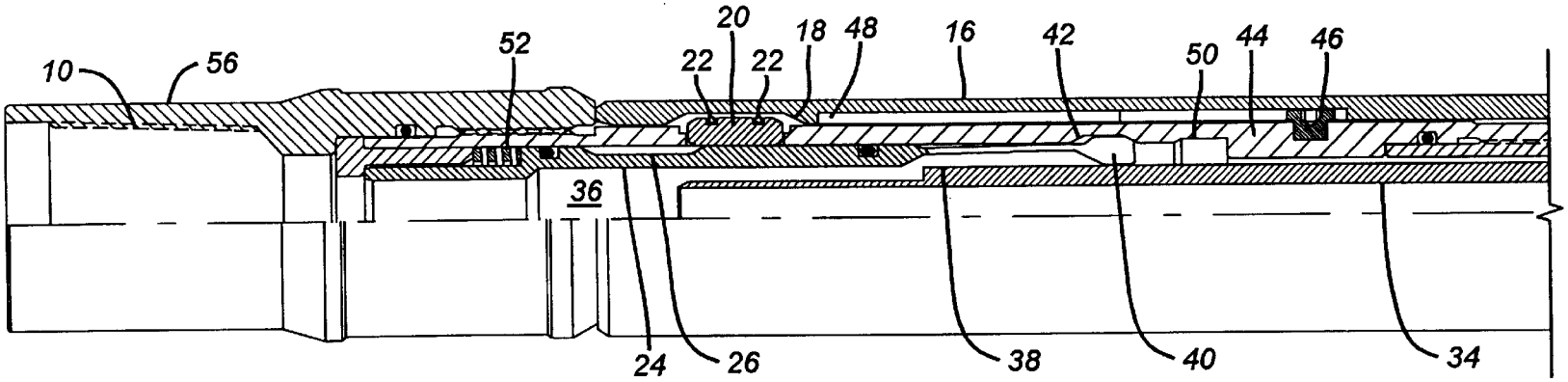
FIGS. 1*a–f* are a sectional elevational view of the bridge plug and packer in the run-in position.
Figure 1B:
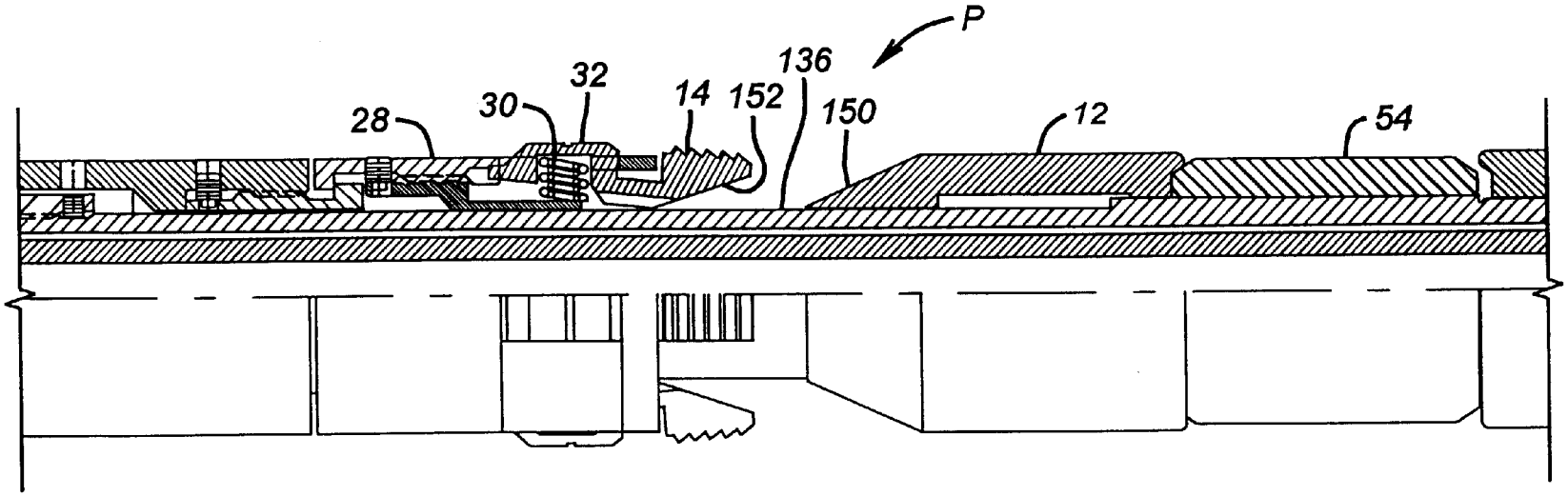
Figure 1C:
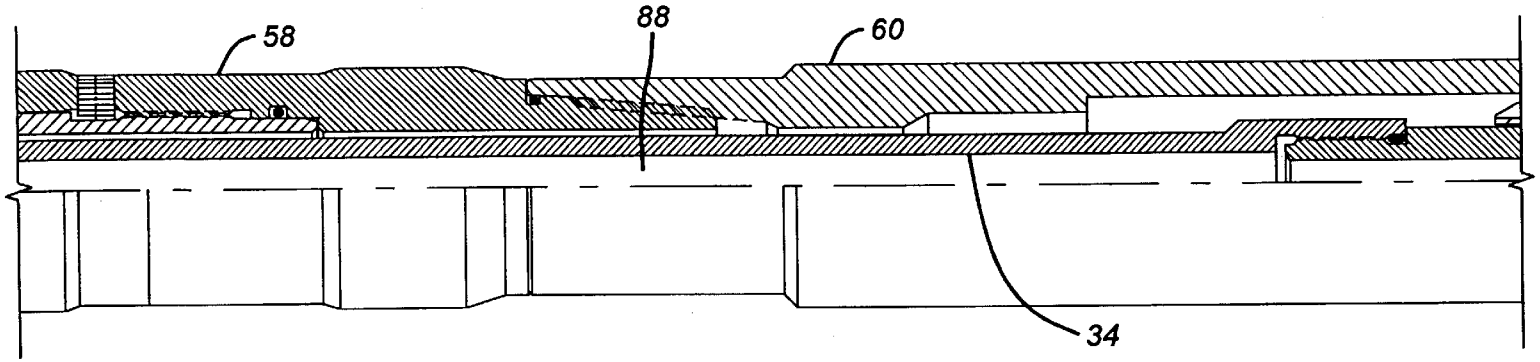
Figure 2A:
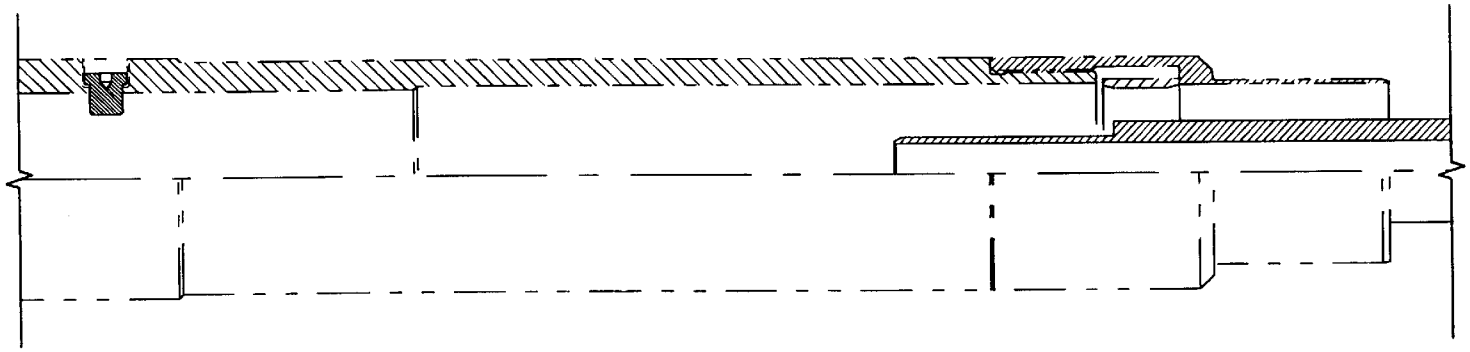
FIGS. 2*a–d* illustrate the bridge plug in the set position with the packer pulled away.

In the preferred embodiment, a packer P and a bridge plug BP are connected together for run-in to a wellbore (not shown) on coiled tubing or threaded tubing or drill pipe (not shown) which is secured to the assembly at thread 10. In the run-in position, relative movement between the cone 12 and the slips 14 is not possible. The reason for this is that the slips 14 are connected through a series of components to ratchet housing 16. Ratchet housing 16 has a groove 18. A series of segmented locking dogs 20, held together by garter springs 22, are locked into groove 18 by virtue of lock collet member 24. Lock collet member 24 has a groove 26 which, when aligned with dogs 20, allows them to exit from groove 18. The slips 14 are pivotally mounted to swivel retainer 28 and are biased outwardly by concentric springs 30. By design, surface 32 is intended to rub on the tubing or casing (not shown) to provide temporary support for the packer P in the setting operation as will be described below. When the bridge plug BP and the packer P are connected together for run-in, an elongated tubular stinger 34 extends into bore 36 of the packer P. Stinger 34 has a surface 38 which supports collet heads 40 in groove 42 of the upper body 44. Upper body 44 also has a pin 46 which extends into an indexing assembly 48 located on ratchet housing 16 (see FIGS. 1*a* and 5). Upper body 44 also has a groove 50 whose purpose will be explained below with the operation of the assembly. A spring 52, shown in the compressed state in FIG. 1*a*, biases lock collet member 24 downward when the collet heads 40 are liberated due to their movement away from surface 38. In essence, when the collet heads 40 become liberated, the spring 52 pushes them into groove 50, which puts groove 26 opposite dogs 20, thus allowing them to come out of groove 18 under the power of garter springs 22. This, in turn, allows operation of the pin 46 in the J-slot mechanism 48 to accomplish the setting of the packer P, as will be explained below.

Packer P also has a sealing element 54 which is ultimately set by an upward pull on top sub 56, which in turn brings the upper cone 12 under the slips 14 and thereafter pulls bottom sub 58 upwardly, bringing it closer to cone 12 and squeezing element 54 in the process. In this particular design, the set of the packer P is held by retaining an upward tensile force on top sub 56.

Figure 1D:
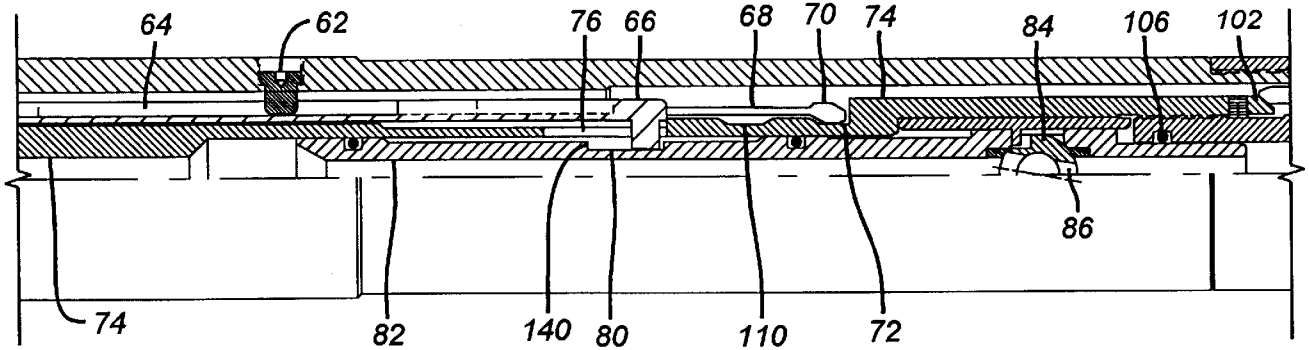
Figure 6:
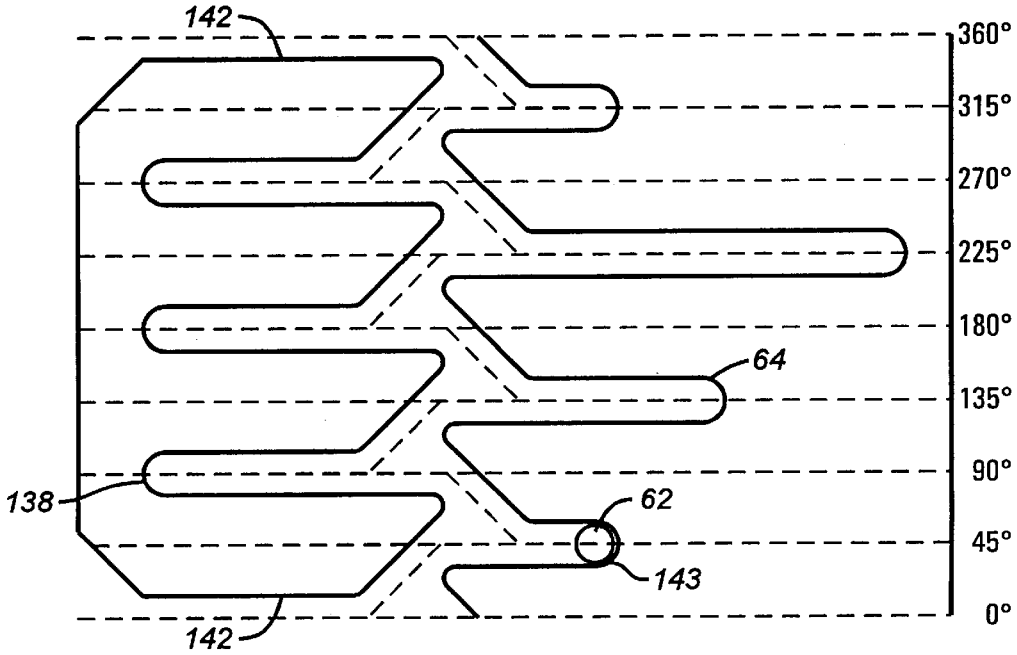
FIG. 6 illustrates the position of the pin in a J-slot for the bridge plug in the bridge plug set position just before release of the service packer from the bridge plug.

Extending from bottom sub 58 is J-pin retainer 60. Retainer 60 holds pin 62, which is operable in a series of slots 64 (see FIG. 6). Slots 64 are part of J-pin latch adapter 66. Latch adapter 66 has a plurality of collet fingers 68 which terminate in collet heads 70, which during run-in are in groove 72 of ball housing 74. Ball housing 74 has an opening 76 through which extends index tab 78. Index tab 78 is a part of J-pin latch adapter 66. Index tab 78 extends into groove 80 of ball shifting sleeve 82. Groove 80 is longer than index tab 78, as shown in FIG. 1*d*. Sleeve 82 is operably connected to ball 84, shown in the open position for run-in, with its openings 86 aligned with central bore 88, which allows flow through the assembled packer P and bridge plug BP. This flow to create circulation assists in running the assembly of the bridge plug BP and the packer P into the hole. At the bottom end of the assembly is choke 89 which, when flow is increased to a predetermined amount, creates backpressure in bore 88. Other devices that create backpressure in bore 88 can be used.

Also connected at the lower end of J-pin retainer 60 is a release probe 90. Release probe 90 has an internal shoulder 92 which retains snap latch 94. Snap latch 94 is an annular ring that rides over snap latch collet 96. Snap latch collet 96 has an external shoulder 98 which retains snap latch 94 in view of the fact that the collet heads 100 are in contact with lower end 102 of ball housing 74. Lower body 104 is secured to ball housing 74 at thread 106. Lower body 104 has an external shoulder 108 which defines a travel limit for snap latch collet 96. It should be noted that the space between the lower end 102 of ball housing 74 and external shoulder 108 on lower body 104 is greater than the length of snap latch collet 96 for reasons which will be explained below.

Figure 2B:
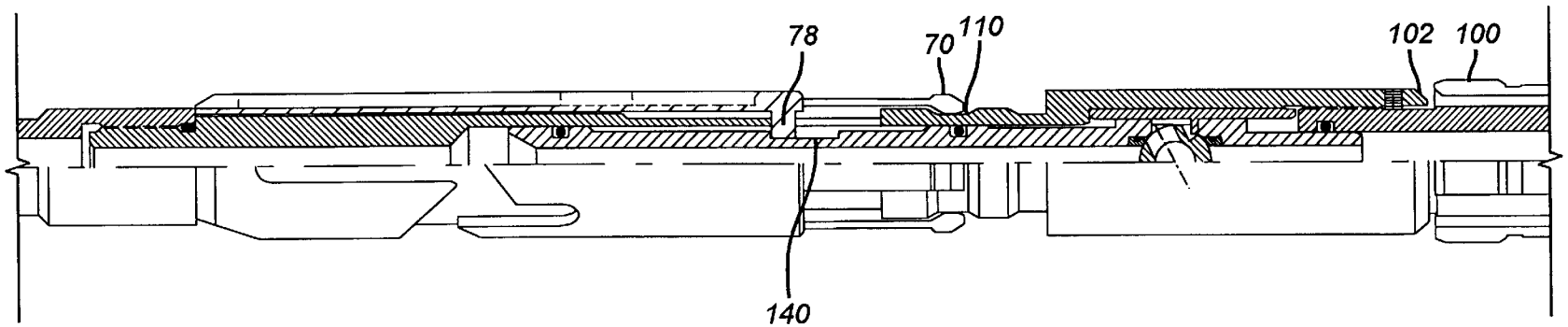
Figure 1E:
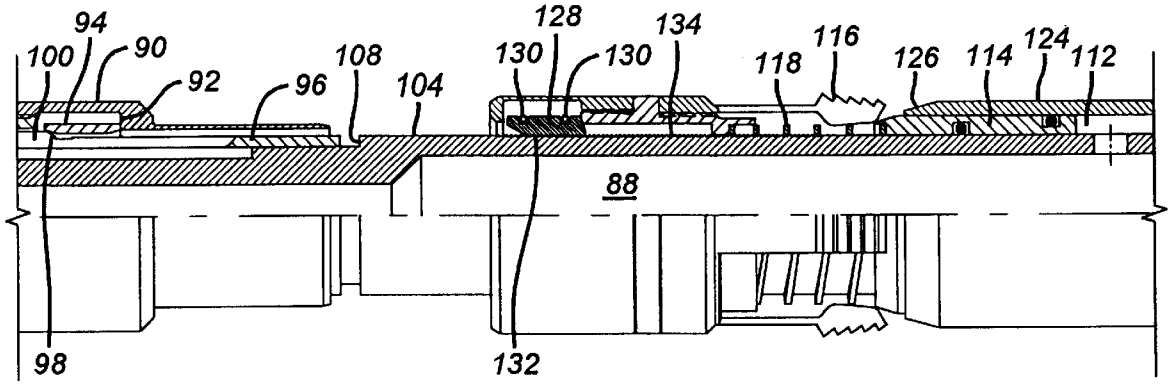

Ball housing 74 has a groove 110 adjacent to groove 72 to retain collet heads 70 after the bridge plug BP is set, as shown in FIG. 2*b*, for reasons which will be explained below.

The bridge plug BP is set by initially pressurizing bore 88 through an increase of flow through choke 89. Pressure build-up in bore 88 results in a build-up of pressure in chamber 112, which in turn drives slip extension piston 114 under slip fingers 116. Movement of piston 114 compresses spring 118 as the slip fingers are pushed out for initial bite into the tubing or casing (not shown). An upward pull on the lower body 104 brings up guide 120 to compress the elements 122, as well as bringing up lower cone 124 so that its taper 126 cams the slip fingers 116 outwardly against the tubing or casing (not shown).

Body lock segments 128 are held to lower body 104 by garter springs 130. Segments 128 have a tooth profile 132 which rides on tooth profile 134 of lower body 104, thus the segments 128 help to retain the set of the bridge plug BP after a sufficient pick-up force on lower body 104 is applied with the slips 116 engaged due to pressurization in chamber 112.

The major components of the assembly of the bridge plug BP and the service packer P now having been described, the operation will be reviewed in more detail.

In order to operate the assembly previously described, coiled or threaded tubing or drillpipe is connected to threads 10 and the bridge plug BP and packer P are lowered to the initial depth for setting of the bridge plug. While the assembly is being lowered, circulation can occur through bore 36 which is connected to bore 88, with the openings 86 in ball 84 aligned with bore 88. Circulation can proceed through choke 89. When the desired depth is reached, the circulation rate is increased to increase the backpressure in bore 88. This, in turn, drives piston 114, which in turn wedges the slips 116 outwardly against the casing or tubing (not shown). When this occurs, an upward force is applied to lower body 104 through the coiled tubing from the surface. The applied pickup force moves taper 126 under slips 116 to further drive them into the casing or tubing (not shown). Additionally, since the slips 116 are now fixed against the casing or tubing (not shown), upward force applied to the lower body 104 brings guide 120 upwardly, compressing the sealing elements 122 against lower cone 124. At the same time, tooth profile 134 is ratcheting past tooth profile 132 on body lock segments 128. As a result of the upward force applied to lower body 104, the bridge plug BP is set, with slips 116 firmly biting the casing or tubing (not shown) and the sealing elements 122 fully compressed.

A further upward pull forces snap latch 94 over heads 100 which are retained by ball housing 74. It should be noted that once the bridge plug BP is set, an upward pull on top sub 56 is transmitted through upper body 44 through mandrel 136 to bottom sub 58, which is in turn connected to J-pin retainer 60 and finally to release probe 90. Shoulder 92 pushes the snap latch 94 such that it is radially expanded in order to clear the heads 100. While a pickup force is being applied to top sub 56, J-pin retainer 60 is also moving up so that pin 62 winds up in position 138 shown in FIG. 6. When this occurs, upward movement of J-pin retainer 60 takes with it J-pin latch adapter 66 and moves tab 78 to shoulder 140 of ball shifting sleeve 82. Further upward movement of top sub 56 will shift up ball shifting sleeve 82 so that ball 84 rotates 900 to the position shown in FIG. 2*b*, where the openings 86 are misaligned with bore 88. This effectively closes off bore 88 with the bridge plug BP in the set position.

Figure 2C:
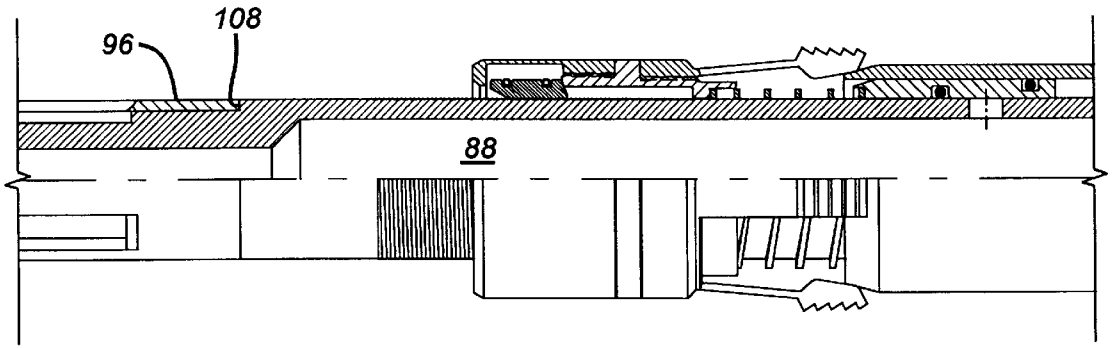
Figure 1F:
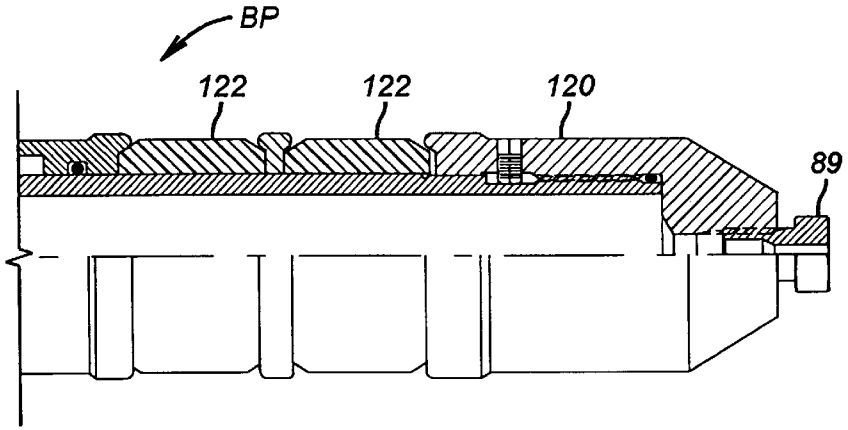
Figure 2D:
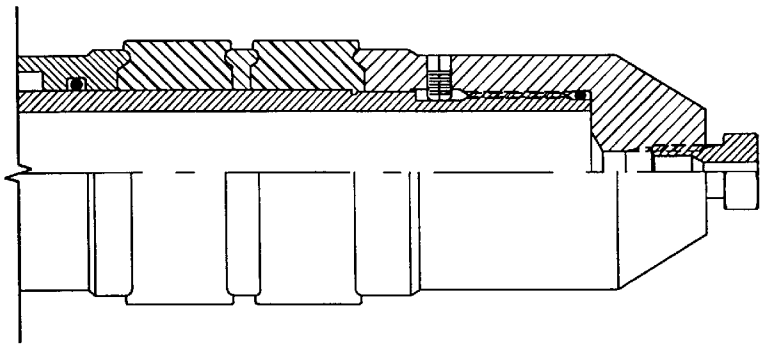
Figure 3A:
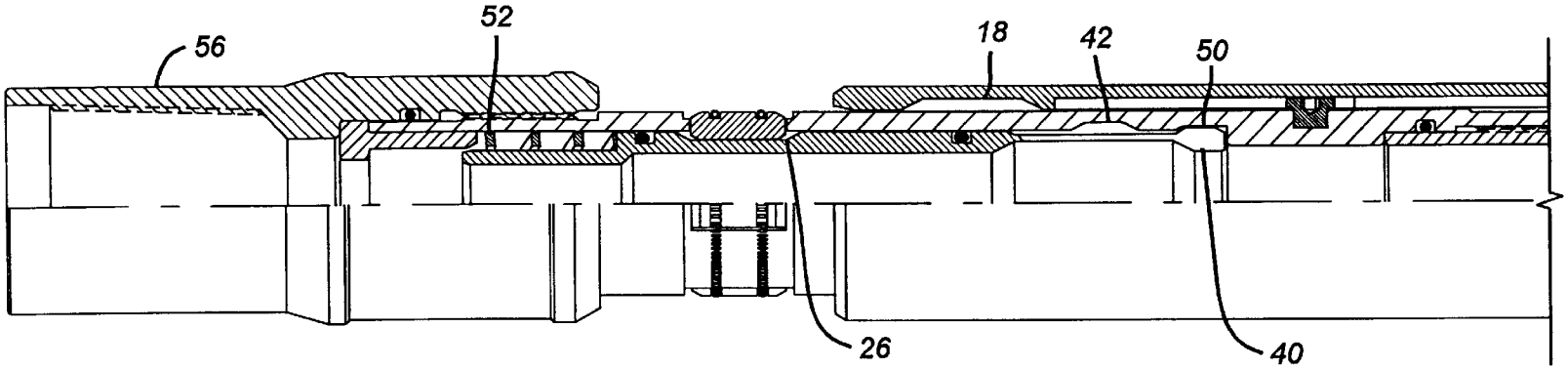
FIGS. 3*a–d* illustrate the packer in a set position after being pulled away from the bridge plug.
Figure 3B:
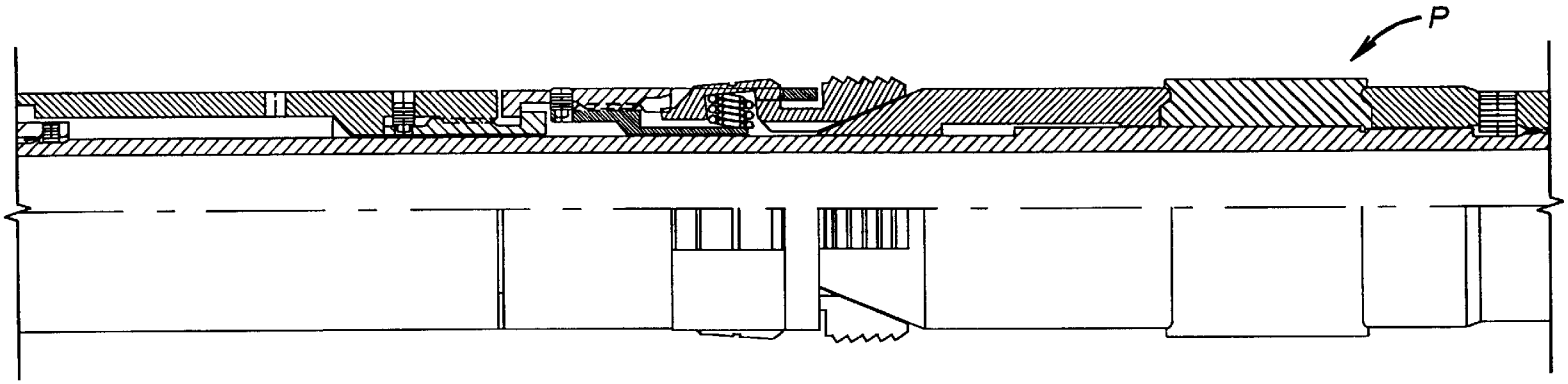
Figure 3C:
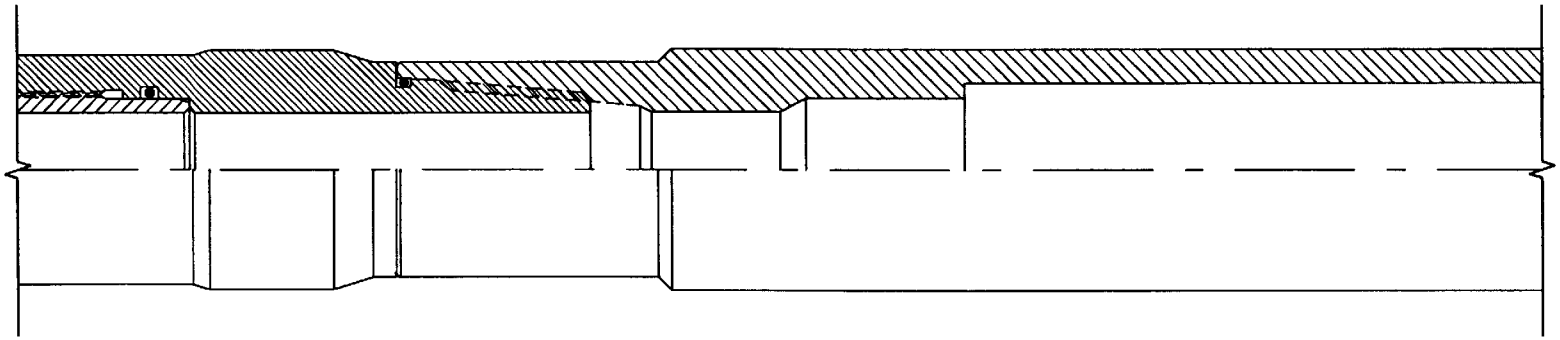
Figure 3D:
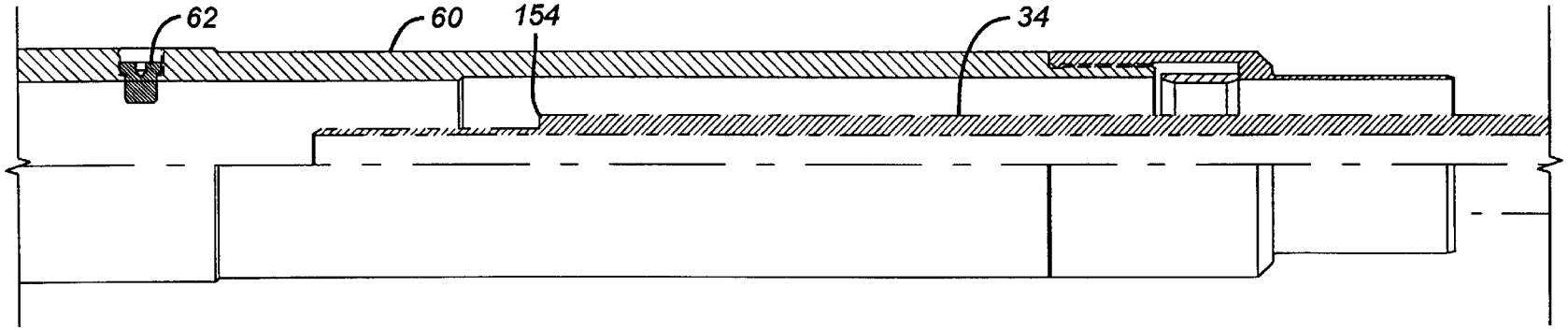
Figure 7:
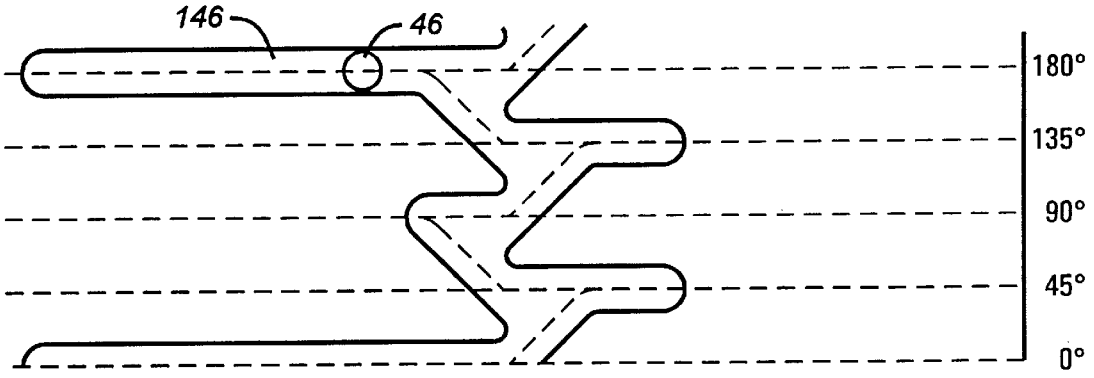
FIG. 7 is the view of FIG. 5, showing the movement of the pin in the J-slot as the packer is set in tension.

To facilitate retaining the ball shifting sleeve 82 in the position with bore 88 closed, the collet heads 70 shift from groove 72 to groove 110, thus, due to their inward bias, effectively holding tab 78 against shoulder 140, as shown in FIG. 2*b*. As shown in FIG. 2*c*, as a result of lifting snap latch 94 over heads 100, snap latch collet 96 has fallen down against shoulder 108 such that heads 100 are no longer supported by lower end 102. The significance of this will be explained at the retrieval portion of the description of the preferred embodiment. The bridge plug BP has now been fully set and the ball 84 moved to the closed position. A setdown force is now applied to top sub 56, which advances pin 62 to position 143, shown in FIG. 6, which upward movement then allows pin 62 to move out of the slots 64 at 142. Further upward movement of top sub 56 will eventually allow the collet heads 40 to be pulled away from surface 38 of stinger 34. Stinger 34 which is affixed to the bridge plug BP stays put as top sub 56 continues to move up. It should be noted that as long as the collet heads 40 are locked to groove 42 by virtue of surface 38, the packer P cannot be set. Upward movement of the packer P relative to the set bridge plug BP frees up the packer P so that it can be set at a desired location. Thus, when collet heads 40 are clear of surface 38, spring 52 pushes lock collet member 24 downwardly until groove 26 is aligned with dogs 20, thus undermining support for dogs 20. The garter springs 22 move the dogs 20 radially inwardly, thus releasing ratchet housing 16 from upper body 44. The packer P is brought to its desired location and surfaces 32, which act as drag blocks under the force of springs 30, temporarily support the packer P to facilitate its setting. Thus, when the proper depth is reached for setting of packer P, a setdown force is applied, moving the pin 46 to position 145, shown in FIG. 5. A pickup force is then applied, moving pin 46 along groove marked 146 in FIG. 5. Since groove 146 is longer than adjacent groove 148, the mandrel 136 can come up, taking with it bottom sub 58 as well as cone 12. Taper 150 on cone 12 catches taper 152 on slips 14 to force them outwardly against the casing or tubing (not shown). Once that occurs, further upward pickup force on top sub 56 brings bottom sub 58 against the sealing element 54 to compress it against the tubing or casing (not shown). This occurs because the bottom sub 58 moves closer to cone 12, which becomes immobile when it pushes slips 14 against the casing or tubing (not shown). This final position with the packer P in the set position is illustrated in FIGS. 3*a–d*. FIG. 7 shows the position of pin 46 in groove 146 while tension is held on the packer P to hold its set. While FIG. 3*d* shows the J-pin retainer 60 still over the stinger 34, those skilled in the art will appreciate that the packer P can be set anywhere once the pin 62 is allowed to exit the slot assembly 64 through position 142. If rigid tubing is used, the packer P can also be of the type that sets or releases with rotation when used in conjunction with a bridge plug BP which is set without rotation. Alternatively, the packer P and bridge plug BP can both be set with some rotation.

Those skilled in the art will now appreciate some of the benefits of the assembly described. In more general terms, a bridge plug BP and a packer P can be run in the hole, particularly on coiled tubing, and set without rotation. Thus, in deviated wellbores or even horizontal wellbores where coiled tubing use is prevalent, the assembly described above can be used to isolate a zone of any predetermined length. The separation between the bridge plug BP and the packer P occurs downhole. The packer P is locked against setting until after the packer P is released from the bridge plug BP, with the bridge plug BP already in a set position. The assembly facilitates circulation during run-in by leaving bore 88 open through positioning of ball 84. The setting of the bridge plug BP incorporates in it the closure of bore 88 through the 90° rotation of ball 84. Thus, when the packer P is disconnected from the bridge plug BP, the bridge plug BP is set in the casing or tubing (not shown) in a sealing manner, with the internal passage 88 closed off by virtue of ball 84. The packer P can then be set in any desired position and will not set until it is separated from the stinger 34, raised to its proper position, lowered and raised again so that it can be held in the set position shown in FIG. 3 under an applied tensile load. Those skilled in the art will appreciate that although the packer P has been shown to be a tension-set packer, it can also be compression-set or hydraulically set as an inflatable. The bridge plug BP has been illustrated as being set by a combination of fluid pressure and a longitudinal force. However, other types of bridge plugs are within the scope of the invention, particularly when they can be set without rotation. Other types of tools can also be used instead of a packer P or bridge plug BP. Anchors, which don't seal, or a whipstock are just a few examples.

Figure 4A:
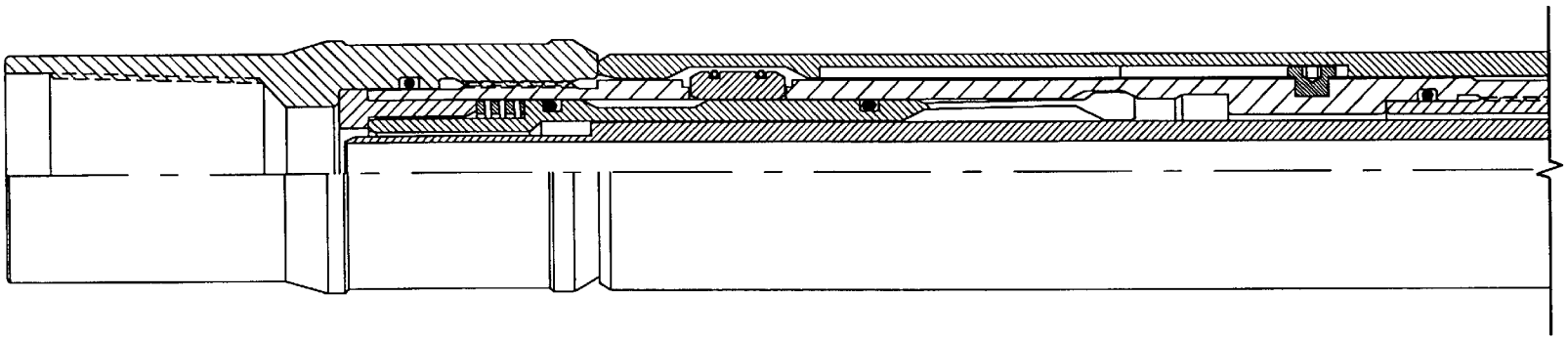
FIGS. 4*a–e* illustrate the packer released and the bridge plug recaptured prior to the release of the bridge plug.
Figure 4B:
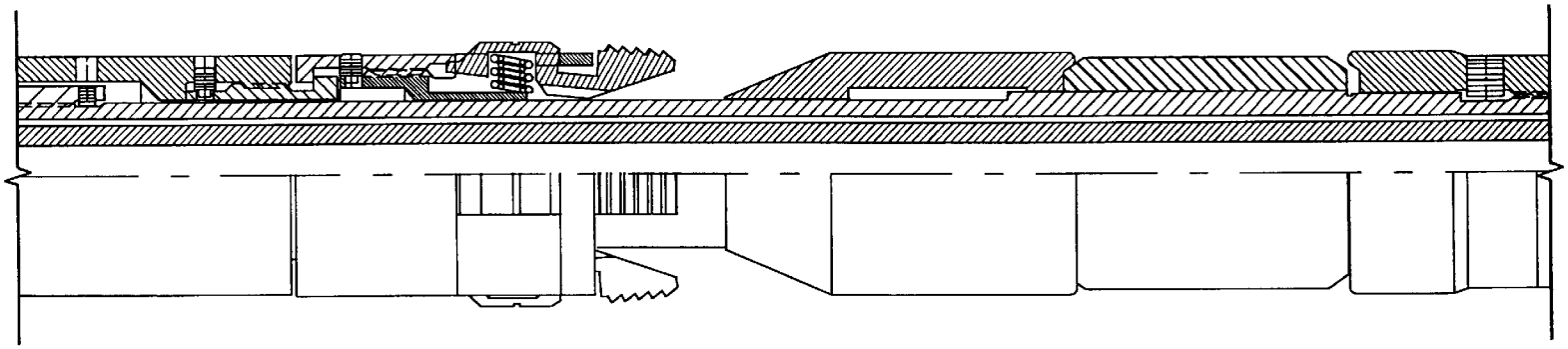
Figure 4C:
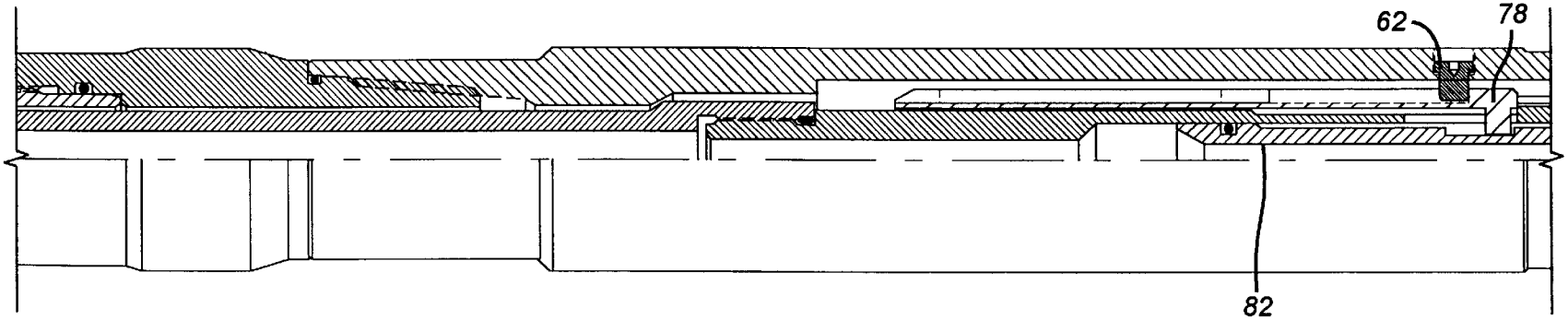
Figure 8:
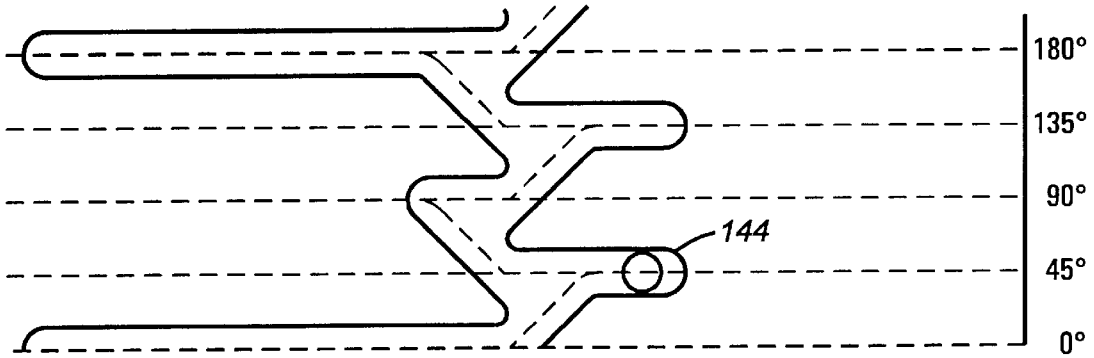
FIG. 8 is the view of FIG. 7, with the pin in the J-slot position for recapture of the bridge plug.

As previously stated, the assembly of the bridge plug BP and the packer P can be redeployed without tripping out of the wellbore. Leading up to redeployment is the procedure to release the packer P and reconnect it to the bridge plug BP just before releasing the bridge plug BP. When all that occurs, the run-in position of FIG. 1 is reobtained and the whole process can be repeated as many times as necessary. Accordingly, when the formation treatment through the coiled tubing (not shown) between the elements 54 and 122 is completed, it is desirable to release the set of the packer 54. A setdown force is applied to top sub 56, moving the pin 46 to the position 144 shown in FIG. 8. As the packer P is lowered to contact the bridge plug BP, shoulder 154 on stinger 34 eventually contacts the collet heads 40 (see FIG. 3*d*). Shoulder 154 pushes the collet heads 40, which are at this time located in groove 50, against the force of spring 52. Previously, spring 52 had been holding groove 26 adjacent the dogs 20 so that they can stay in the retracted position illustrated in FIG. 3*a*. However, when the shoulder 154 on the stinger 34 pushes the collet heads 40 into groove 42, the top sub 56 has landed on ratchet housing 16, putting groove 18 opposite dogs 20. Therefore, as the collet heads 40 are displaced by shoulder 154, groove 26 forces dogs 20 outwardly into groove 18, such that the position shown in FIG. 4*a* is assumed.

Figure 4D:
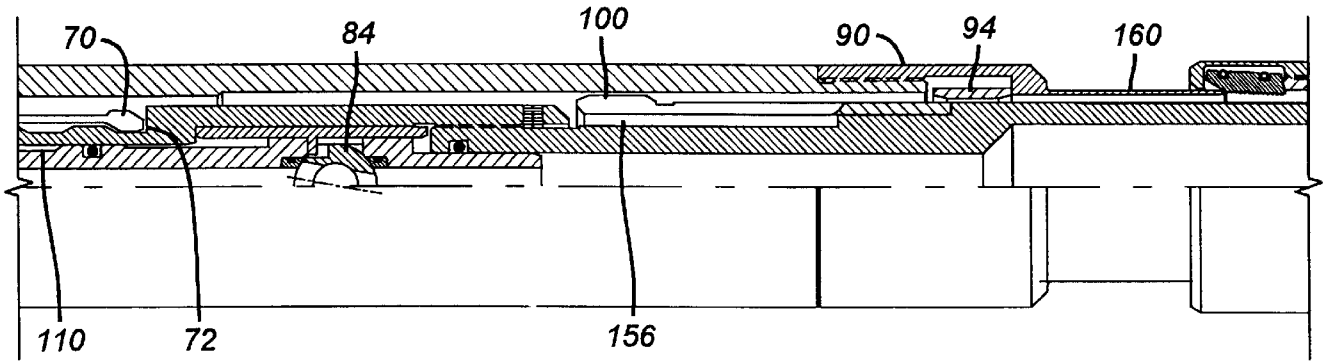
Figure 4E:
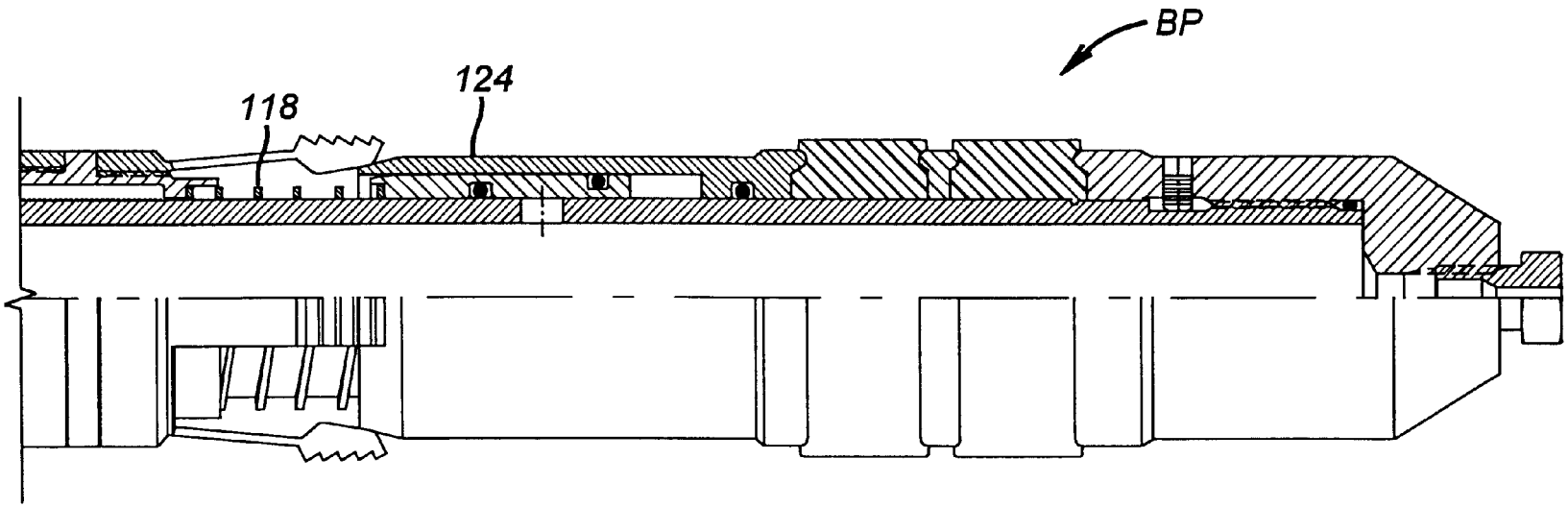
Figure 5:
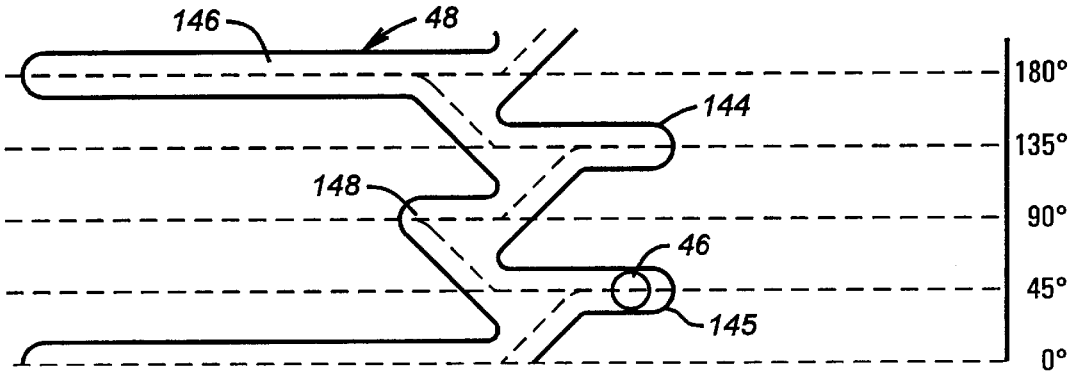
FIG. 5 illustrates the position of the pin in a J-slot mechanism for the packer in the run-in position.
Figure 9:
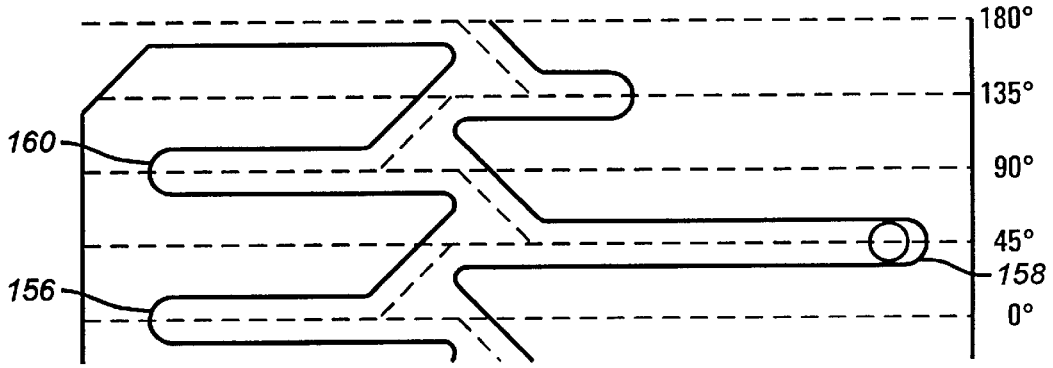
FIG. 9 is the view of FIG. 6, with the pin in the position where the bridge plug has been captured and released.

At this time, further setdown force on top sub 56 brings the BP pin 62 into position 142 of the ratchet shown in FIG. 5. At this time the snap latch collet 96 is against shoulder 108, allowing the heads 100 to flex radially inwardly into recess 156 as the snap latch 94 is pushed over the collet heads 100. The packer P is now secured to the bridge plug BP. While this is happening, the J-pin latch adapter 66 is pushed downwardly, pushing tab 78 away from shoulder 140 in groove 80. As this occurs, the collet heads 70 are forced from groove 110 into groove 72 (see FIG. 4*d*). The downward shifting of tab 78 moves ball shifting sleeve 82 downwardly to rotate ball 84 into the open position shown in FIG. 4*d*. At this time the bridge plug BP is still set but differential pressure has now been equalized through the rotation of ball 84. At this time a pickup force is applied which advances pin 62 to position 160 shown in FIG. 9. The snap latch 94 shoulders against the collet heads 100. The bridge plug BP can then be released by a setdown force on top sub 56 which moves the pin 62 to position 158 shown in FIG. 9. The lower end 160 of the release probe 90 (see FIG. 4*d*) gets under body lock segments 128 and pushes them upwardly so as to disengage tooth profiles 132 and 134. A further downward force pulls out the lower cone 124 from under the slips 116 while extending the sealing elements 122. The bridge plug BP is now released, and the spring 118 pushes the slips 116 upwardly so that they can retract to the position shown in FIG. 1*e*. A pickup force will reposition the pin 62 at position 156 which, in turn, brings the snap latch 94 against the collet heads 100. In essence, the position of FIG. 1 is resumed, allowing the assembly to be repositioned in the wellbore for a repetition of the procedure at a different location.

The foregoing disclosure and description of the invention are illustrative and explanatory thereof, and various changes in the size, shape and materials, as well as in the details of the illustrated construction, may be made without departing from the spirit of the invention.

What is claimed:

1. A method of performing a downhole procedure involving at least a first and a second tool, each having a longitudinal axis, comprising:

running in a first and a second tool together;

deploying said first tool;

releasing said second tool from said first tool;

repositioning said second tool;

performing the downhole procedure;

reengaging said second tool to said first tool;

repositioning said first and second tools in the wellbore; and deploying at least one of said first and said second tools without rotation.

2. The method of claim 1, further comprising:

setting at least in part at least one of said first and second tools using pressure created by flowing fluid therethrough.

3. The method of claim 2, further comprising:

using longitudinal movement to complete setting of said first and second tools.

4. A method of performing a downhole procedure involving at least a first and a second tool, each having a longitudinal axis, comprising:

running in a first and a second tool together;

deploying said first tool;

releasing said second tool from said first tool;

repositioning said second tool;

deploying at least one of said first and said second tools without rotation;

deploying both said first and second tools without rotation;

mounting said first tool below said second tool;

locking said second tool so it cannot set by longitudinal movement while said first tool is set by longitudinal movement.

5. The method of claim 4, further comprising:

initiating set of said first tool by pressure; and concluding the set of said first tool with said longitudinal movement.

6. The method of claim 4, further comprising:

unlocking said second tool so that it can be set by longitudinal movement as a result of said releasing of said second tool from said first tool.

7. A method of performing a downhole procedure involving at least a first and a second tool, each having a longitudinal axis, comprising:

running in a first and a second tool together;

deploying said first tool;

releasing said second tool from said first tool;

repositioning said second tool:

deploying at least one of said first and said second tools without rotation;

setting at least in part at least one of said first and second tools using pressure created by flowing fluid therethrough;

closing a valve in said first tool as a result of a release of said second tool from said first tool.

8. The method of claim 7, further comprising:

using said second tool to shift a sleeve on said first tool;

rotating a ball to close off said first tool as said second tool is pulled away;

latching said sleeve in position after rotating said ball.

9. The method of claim 6, further comprising:

using a ratchet assembly on said second tool;

releasing a pin to move in a slot as a result of release of said second tool from said first tool;

applying a tensile force to said second tool to set it.

10. A method of performing a downhole procedure involving at least a first and a second tool, each having a longitudinal axis, comprising:

running in a first and a second tool together;

deploying said first tool;

releasing said second tool from said first tool;

repositioning said second tool;

deploying at least one of said first and said second tools without rotation;

using a latch to hold said first and second tools for run-in;

overcoming said latch, after said first tool is set, with a longitudinal movement of said second tool;

relatching said second tool to said first tool by setting down said second tool on said first tool with said first tool set.

11. A method of performing a downhole procedure involving at least a first and a second tool, each having a longitudinal axis, comprising:

running in a first and a second tool together;

deploying said first tool;

releasing said second tool from said first tool;

repositioning said second tool;

deploying and unsetting said first and second tools without rotation;

releasing and reengaging said first and second tools without rotation.

12. The method of claim 10, further comprising:

providing a valve in said first tool;

closing said valve as a result of overcoming said latch;

releasably latching said valve in the closed position while said first and second tools are separated.

13. The method of claim 10, further comprising:

holding the set of said first tool with a releasable lock;

overcoming said releasable lock with said second tool after said second tool has been relatched to said first tool.

14. The method of claim 13, further comprising:

providing a valve in said first tool;

closing said valve as a result of overcoming said latch;

releasably latching said valve in the closed position while said first and second tools are separated.

15. The method of claim 14, further comprising:

overcoming said latch on said valve when latching said second to said first tool;

opening said valve when relatching said second to said first tool.

16. The method of claim 1, further comprising:

using sealing devices as said first and said second tools.

17. The method of claim 16, further comprising:

setting both sealing devices without rotation.

18. The method of claim 17, further comprising:

using a bridge plug and a packer as said sealing devices.

* * * * *